US008503923B2

(12) United States Patent
Asada et al.

(10) Patent No.: US 8,503,923 B2
(45) Date of Patent: Aug. 6, 2013

(54) IMAGE RECORDING APPARATUS

(75) Inventors: Tetsuo Asada, Kuwana (JP); Naokazu Tanahashi, Nagoya (JP); Shota Iijima, Nagoya (JP); Masatoshi Izuchi, Ichinomiya (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 339 days.

(21) Appl. No.: 12/560,368

(22) Filed: Sep. 15, 2009

(65) Prior Publication Data

US 2010/0166473 A1 Jul. 1, 2010

(30) Foreign Application Priority Data

Dec. 26, 2008 (JP) ..... 2008-332622

(51) Int. Cl.
*G03G 15/00* (2006.01)
*B65H 85/00* (2006.01)

(52) U.S. Cl.
USPC ..... 399/405; 399/21; 399/393

(58) Field of Classification Search
USPC ..... 399/405, 393, 21, 401, 23, 388, 124; 271/171, 164, 163
See application file for complete search history.

(56) References Cited

U.S. PATENT DOCUMENTS 5,060,927 A * 10/1991 Sugiura ..... 271/117
5,132,742 A * 7/1992 Goto ..... 399/401
5,975,517 A * 11/1999 Lim ..... 271/117
7,946,574 B2 * 5/2011 Bauvin et al. ..... 271/161
2007/0057438 A1 * 3/2007 Kurokawa et al. ..... 271/164
2008/0240824 A1 10/2008 Asada

FOREIGN PATENT DOCUMENTS

CN 1931688 A 3/2007
JP 11246132 A * 9/1999
JP H11-246132 A 9/1999
JP 2008-247537 A 10/2008

OTHER PUBLICATIONS

The State Intellectual Property Office of the People's Republic of China, Notification of First Office Action for Chinese Patent Application No. 200910211821.9 (counterpart to above-captioned patent application), mailed Jan. 5, 2012.

* cited by examiner

*Primary Examiner* — Matthew G Marini
*Assistant Examiner* — Ruben Parco, Jr.
(74) *Attorney, Agent, or Firm* — Baker Botts L.L.P.

(57) ABSTRACT

An image recording apparatus includes a particular tray, a sheet feeder configured to feed a sheet from the particular tray to a first conveying path in a feed direction, a recording unit positioned along the first conveying path, and a driving roller positioned along a second conveying path and configured to convey the sheet, after the sheet passes the recording unit, along the second conveying path and back to the first conveying path. The particular tray includes a side guide configured to position the sheets in a widthwise direction perpendicular to the feeding direction. The side guide includes a guide member that defines at least a portion of the second conveying path and is configured to guide the sheet along the second conveying path, and a driven roller rotatably supported on the guide member and configured to pinch the sheet against the driving roller as the sheet is conveyed along the second conveying path.

13 Claims, 10 Drawing Sheets

IMAGE RECORDING APPARATUS

CROSS REFERENCE TO RELATED APPLICATION

This application claims priority from Japanese Patent Application No. 2008-332622, which was filed on Dec. 26, 2008, the disclosure of which is incorporated herein by reference in its entirety.

BACKGROUND OF THE INVENTION

1. Field of the Invention

This application relates to an image recording apparatus that records an image on a sheet of recording medium conveyed from a tray to a recording unit, and relates more particularly to an image recording apparatus that conveys a sheet back to the recording unit after a recording unit records an image on one side of the sheet.

2. Description of Related Art

A known image recording apparatus, such as the image recording apparatus described in Japanese Laid-Open Patent Application No. 2008-247537 records an image on both sides of a sheet. In such an image recording device, a recording unit records an image on the front side of a sheet conveyed from a tray along a first conveying path, and the sheet having an image recorded on the front side thereof is conveyed by a pair of rollers along a second conveying path back to the recording unit. Then, the recording unit records an image on the back side of the sheet.

In the known image recording apparatus, if a sheet having an image recorded on the front side thereof is jammed when the sheet is conveyed along the second conveying path while being pinched by the pair of rollers, the jammed sheet has to be removed from the pair of rollers. If the jammed sheet is pulled by force from the pair of rollers, ink of the image recorded on the sheet may adhere to a roller surface. The ink adhered to the roller surface may stain a sheet to be fed next and may deteriorate the quality of an image to be recorded.

SUMMARY OF THE INVENTION

Therefore, an object of the invention is to provide an image recording apparatus which overcomes these and other shortcomings of the related art. A technical advantage of the present invention is that a jammed sheet may be removed readily from a pair of rollers that is disposed along a path back to a recording unit.

According to an embodiment of the invention, an image recording apparatus comprises a particular tray configured to hold a plurality of sheets on a sheet holding surface, a sheet feeder configured to feed a sheet of the plurality of sheets to a first conveying path in a feed direction, a recording unit positioned along the first conveying path and configured to record an image on the fed sheet, and a driving roller positioned along a second conveying path and configured to convey the sheet, after the sheet passes the recording unit, along the second conveying path and back to the first conveying path. The first conveying path and the second conveying path overlap at positions upstream and downstream of the recording unit in the feed direction. The particular tray comprises at least one side guide configured to contact and to position the plurality of sheets in a widthwise direction perpendicular to the feeding direction. The at least one side guide of the particular tray each comprises a guide member that defines at least a portion of the second conveying path and is configured to guide the sheet along the second conveying path, and a driven roller rotatably supported on the guide member and configured to contact the driving roller, and to pinch the sheet against the driving roller as the sheet is conveyed along the second conveying path.

DETAILED DESCRIPTION OF EMBODIMENTS

Figure 1:
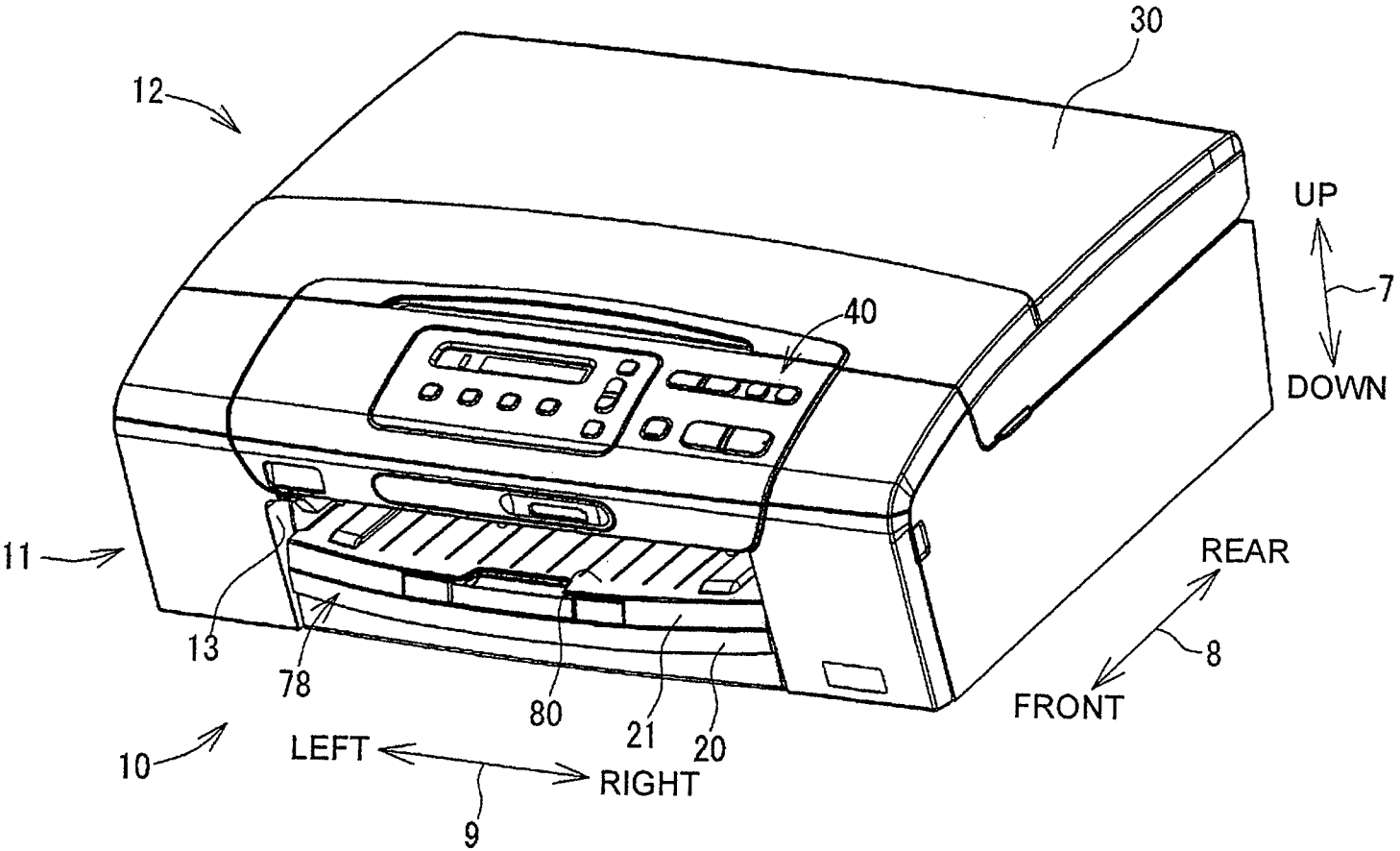
FIG. 1 is a perspective view of an image recording apparatus, e.g., a multi-function device, according to an embodiment of the invention.

For a more complete understanding of the invention, the needs satisfied thereby, and the features and technical advantages thereof, reference now is made of the following descriptions taken in connection with the accompanying drawings.

In the following description, the expressions "front", "rear", "upper", "lower", "right", and "left" are used to define the various parts when an image recording apparatus, e.g., a multi-function device 10 is disposed in an orientation in which it is intended to be used. Arrow 7 shows an up-down direction, arrow 8 shows a front-rear direction, and arrow 9 shows a right-left direction.

The multi-function device 10 comprises a printer 11 disposed at the bottom, a scanner 12 disposed at the top, and an operation panel 40 disposed at the front top of the device 10. The multi-function device 10 may perform one or more functions, e.g., printing, coping, scanning, facsimile functions, or any combination thereof.

The printer 11 has an opening 13 at the front of a housing of the device 10. A sheet cassette 78 is inserted into and removed from the printer 11 through the opening 13. The sheet cassette 78 stores various sizes of recording medium, e.g., sheets. The sheet cassette 78 comprises an upper tray 21 and a lower tray 20. The upper tray 21 is disposed on the lower tray 20.

The scanner 12 may be a flatbed scanner. A document cover 30 is disposed at the top of the scanner 12 and serves as a top plate of the multi-function device 10. A platen glass (not shown) is disposed under the document cover 30. The scanner 12 reads a document placed on the platen glass and covered by the document cover 30.

The operation panel 40 for operating the printer 11 and the scanner 12 comprises operation buttons and a liquid crystal display. The operation panel 40 allows a user to perform various settings and operations, e.g., setting of the type of sheet (plain paper, postcard, etc.), the printing mode (single-sided mode or double-sided mode), and the resolution (draft mode or photo mode).

The printer 11 comprises, in addition to the sheet cassette 78, a sheet feeder 15, recording unit 24, and path switching unit 41. The sheet feeder 15 feeds a sheet from one of the upper and lower trays 21, 20 of the sheet cassette 78. The recording unit 24 records an image on the sheet fed by the sheet feeder 15 by an ink-jet method, an electrophotographic method, or a thermal method. The path switching unit 41 directs the sheet having an image printed on a front side (first side) thereof to a path for recording an image on a back side (second side) of the sheet.

A first conveying path 65 is defined in the printer 11 and extends from one end of the lower tray 20 to a cover 79, via the recording unit 24. The first conveying path 65 comprises a curved path 65A extending from one end of the lower tray 20 to the recording unit 24, and a discharging path 65B extending from the recording unit 24 to a sheet receiving surface 79. A sheet fed from the lower tray 20 or the upper tray 21 is conveyed along the first conveying path 65 in a first direction, i.e., in a sheet conveying direction.

Figure 3:
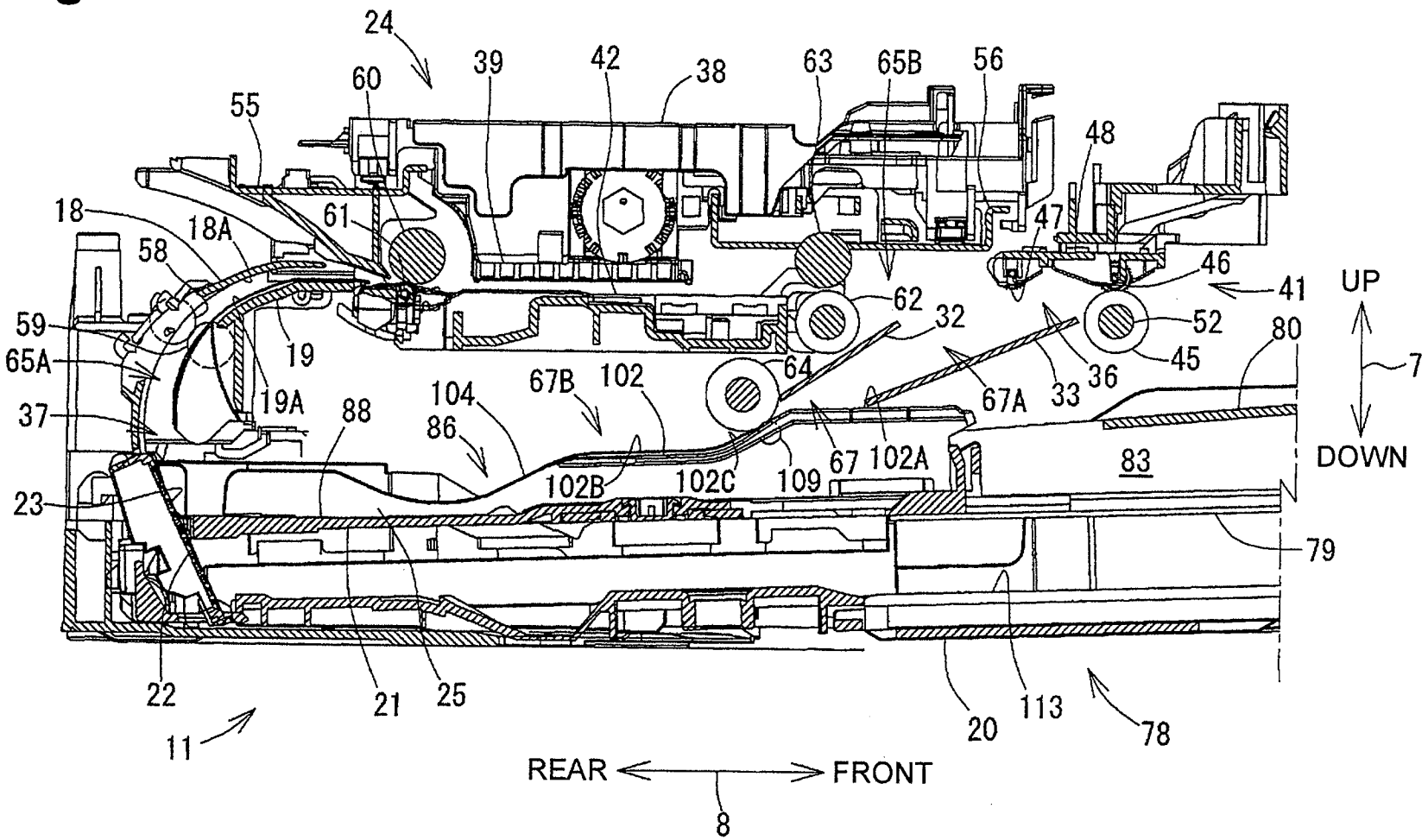
FIG. 3 is a partial enlarged vertical cross-sectional view of the printer of FIG. 2.

As shown in FIG. 3, an outer guide 18 having a guide surface 18A and an inner guide 19 having a guide surface 19A define the curved path 65A. The outer guide 18 extends from a substantially upper end of a separation plate 22 to a substantially rear end of the recording unit 24. The curved path 65A is shaped like a segment of circle with a center positioned between the lower tray 20 and the recording unit 24.

A second conveying path, e.g., a reverse path 67, is defined in the printer 11, between the sheet cassette 78 and the recording unit 24 disposed above the sheet cassette 78. More specifically, the reverse path 67 overlaps with the first conveying path 65 at a branch portion 36 positioned downstream of the recording unit 24 in the first direction and a merge portion 37 positioned upstream of the recording unit 24 in the first direction. The merge portion 37 is positioned at a substantially upstream end of the curved path 65A.

The reverse path 67 comprises an inclined path 67A and a horizontal path 67B. The reverse path 67 is defined by inclined guides 32, 33 that extend from the branch portion 36 rearward and downward in an inclined manner. The inclined guides 32, 33 face each other at a predetermined interval.

The horizontal path 67B extends from the inclined path 67A rearward substantially horizontally. The horizontal path 67B is defined by upper plates 102 (FIG. 4) of side guides 86.

In a single-sided recording mode, a sheet fed by the sheet feeder 15 from the lower tray 20 or the upper tray 21 is guided along the curved path 65A so as to make a U-turn toward the recording unit 24. Then, the sheet having an image recorded on the front side is discharged along the discharging path 65B onto the sheet receiving surface 80. In a double-sided recording mode, the sheet having an image recorded on the front side is guided by the path switching unit 41 to the reverse path 67. The sheet is conveyed, along the inclined path 67A and the horizontal path 67B, back to the curved path 65A. After the recording unit 24 records an image on the back side of the sheet, the sheet is discharged along the discharging path 65B onto the sheet receiving surface 80.

Figure 2:
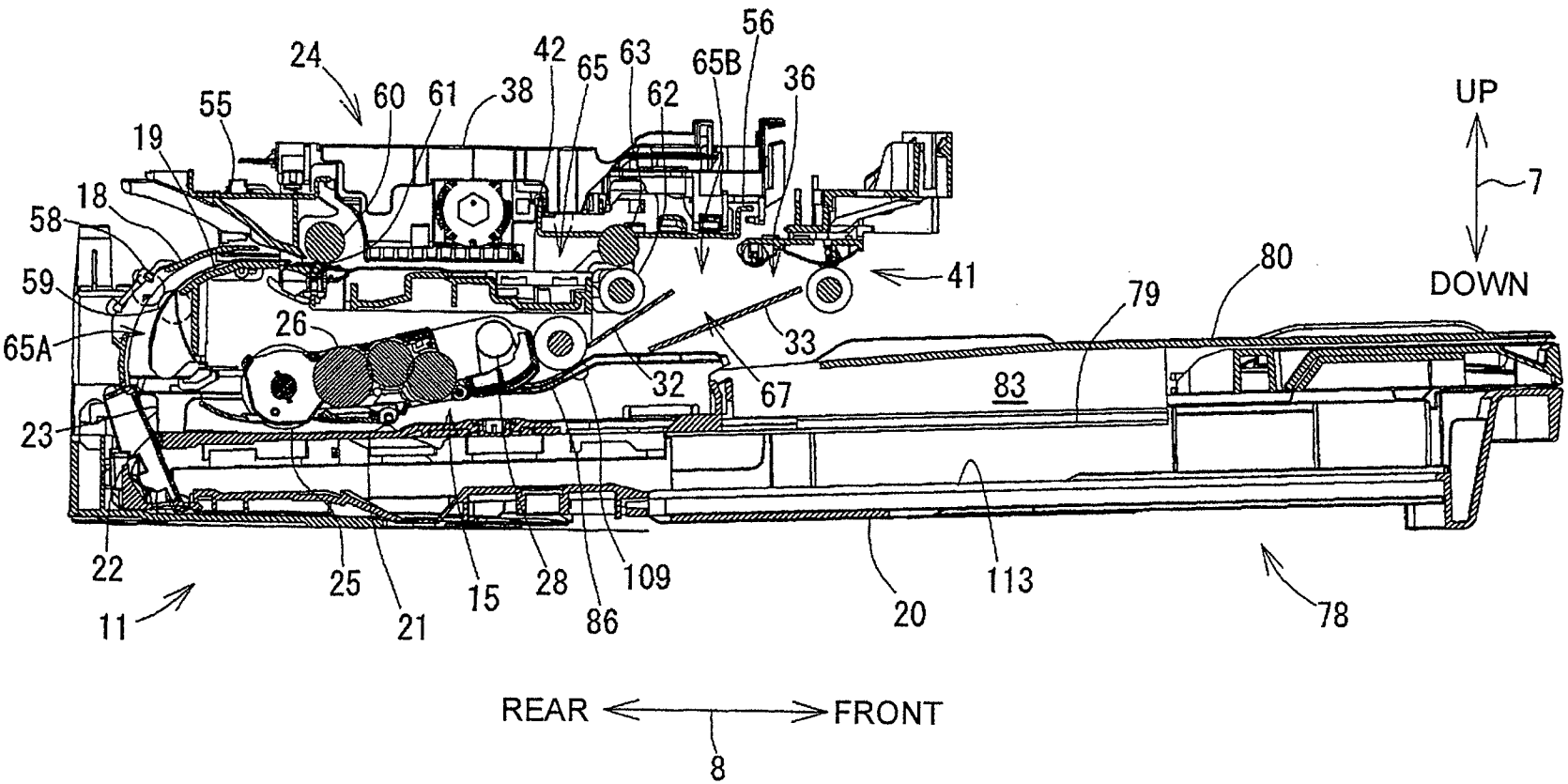
FIG. 2 is a vertical cross-sectional view of a printer according to an embodiment of the invention.

The recording unit 24 is disposed along the first conveying path 65 and above the sheet cassette 78. The recording unit 24 comprises a carriage 38 and a recording head 39. The recording head 39 is mounted on the carriage 38 and is configured to reciprocate along guide rails 55, 56 that extend in a main scanning direction, e.g., a direction perpendicular to a sheet plane of FIG. 2. While reciprocating, the recording head 39 ejects a droplet of ink, which is supplied from an ink cartridge (not shown), onto a sheet conveyed on a platen 42 to form an image on the sheet.

A first convey roller 58 and a first pinch roller 59 are disposed along the curved path 65A. The first convey roller 58 and the first pinch roller 59 are supported rotatably by the outer guide 18 and the inner guide 19, respectively. The first convey roller 58 and the first pinch roller 59 pinch a sheet conveyed along the curved path 65A and convey it toward the recording unit 24.

A second convey roller 60 and a second pinch roller 61 are disposed downstream of the first convey roller 58 and the first pinch roller 59 in the first direction along the first conveying path 65. More specifically, the second convey roller 60 and the second pinch roller 61 are disposed between a downstream end of the curved path 65A and the recording unit 24. The second convey roller 60 and the second pinch roller 61 are supported rotatably by a frame (not shown) of the printer 11. The second pinch roller 61 is disposed below the second convey roller 60 so as to press the second convey roller 60. The second convey roller 60 and the second pinch roller 61 pinch the sheet conveyed along the curved path 65A and convey it onto the platen 42.

A discharge roller 62 and a spur roller 63 are disposed between the recording unit 24 and an upstream end of the discharging path 65B in the first direction. The discharge roller 62 and the spur roller 63 are supported rotatably by the frame (not shown) of the printer 11, and pinch the sheet having an image recorded thereon and conveys downward toward the sheet receiving surface 80.

A third convey roller 64, e.g., a driving roller, is disposed along the reverse path 67. The third convey roller 64 is supported rotatably by the frame (not shown) of the printer 11. The third convey roller 64 is positioned frontward of the sheet feeder 15. More specifically, the third convey roller 64 is positioned frontward of a feed roller 25, i.e., upstream of the feed roller 25 in a second direction, i.e., in a sheet conveying-back direction along the reverse path 67. A third pinch roller 109, e.g., a driven roller, is supported by the corresponding side guide 86 of the upper tray 21, and is configured to contact and press the third convey roller 64 when the sheet cassette 78 is inserted into the printer 11 and the upper tray 2 is in a feed position, as shown in FIG. 3. A length, along the conveying path, from the third convey roller 64 to the first convey roller 58 is adjusted such that a sheet of a smallest size used for the double-sided recording mode is conveyed properly.

The first convey roller 58, second convey roller 60, discharge roller 62, and third convey roller 64 are rotated by a motor (not shown). The first convey roller 58, second convey roller 60, and discharge roller 62 are driven intermittently during image recording such that an image is recorded on a sheet while the sheet is conveyed by a predetermined line feed width at a time.

The sheet feeder 15 is disposed above the sheet cassette 78 and comprises the feed roller 25, a arm 26, and a transmission mechanism (not shown). The feed roller 25 is supported rotatably at a distal end of the arm 26. The feed roller 25 rotates while contacting a sheet in the lower tray 20 or in the upper tray 21 and conveys the sheet to the curved path 65A. The feed roller 25 is driven by a motor (not shown) via the transmission mechanism 27, e.g., gears arranged substantially linearly.

A base end of the arm 26 is supported by a shaft 28 such that the arm 26 pivots about the shaft 28. The shaft 28 is disposed above the inclined path 67A and below the recording unit 24.

The arm 26 pivots vertically such that the feed roller 25 contacts with and moves away from an upper surface of the lower tray 20 or the upper tray 21. The arm 26 is urged downward by its own weight or by a spring or the like. The arm 26 pivots upward by being pushed by a rear end of the sheet cassette 78 when the sheet cassette 78 is inserted into the printer 11.

Referring to FIGS. 4-7, the sheet cassette 78 is described in detail. The sheet cassette 78 comprises the lower tray 20 and the upper tray 21 and the cover 79.

The lower tray 20 is disposed at the bottom of the printer 11. The lower tray 20 is shaped like a box open upward and holds a stack of sheets on a bottom surface 113 substantially horizontally. The lower tray 20 may be configured to store up to A4 size (210 mm×297 mm) sheets and to typically store B5 size sheets and A4 size sheets. A pair of side guides (not shown) is supported on the bottom surface 113 of the lower tray 20 such that they slide in the right-left direction 9. when the side guides are brought into contact with side edges of the sheets stored in the lower tray 20, the sheets are positioned on the bottom surface 113 with respect to a reference point such that a widthwise center of the sheets is aligned with the reference point.

Figure 5:
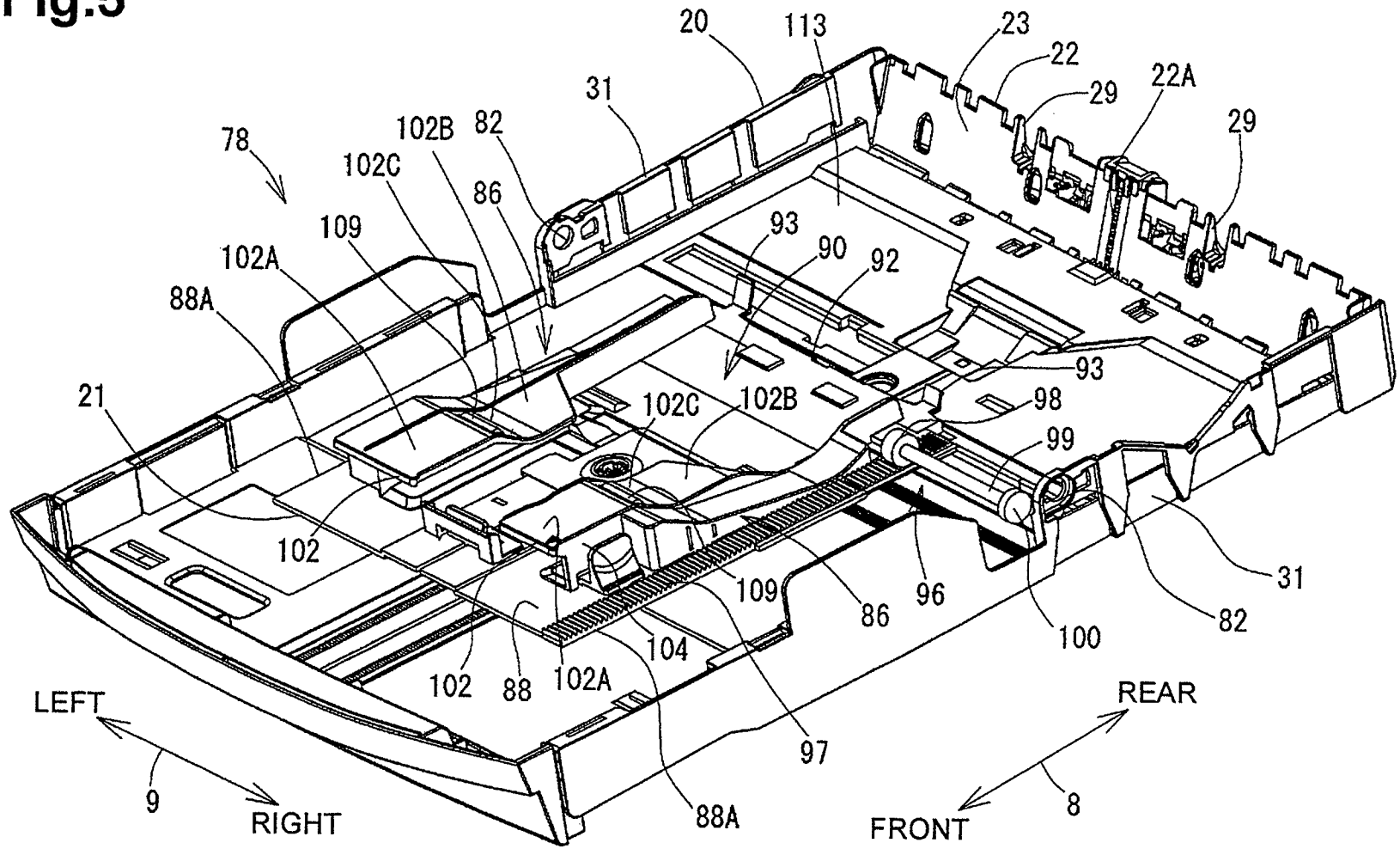
FIG. 5 is a rear perspective view of the sheet cassette from which a tray cover is omitted to show a general structure of the upper tray.

The lower tray 20 comprises the separation plate 22. The separation plate 22 stands upward at a rear end of the lower tray 20 and is inclined rearward. The curved path 65A is defined upward and rearward from an upper end of the separation plate 22. An inner surface 23 of the separation plate guides a sheet to the curved path 65A. When leading edges of sheets fed from the lower tray 20 abut the inner surface 23, the sheets are directed in the inclined direction of the separation plate 22. As shown in FIG. 5, a plurality of claws 22A are arranged vertically at a center of the separation plate 22 in the right-left direction 9 such that the claws 22A project from the inner surface 23. When the leading edges of the sheets abut the inner surface 23, the sheets are separated from each other, and only the uppermost sheet is guided to the curved path 65A. The separation plate 22 has recesses 29 for receiving engaging portion 93 of the upper tray 21.

The cover 79 is attached to the front top of the lower tray 20 such that the cover 79 pivots with respect to the lower tray 20. More specifically, a shaft 81 positioned at a rear end of each side surface of the cover 79 is rotatably supported in a shaft hole 82 (FIG. 5) formed in a corresponding side wall 31 of the lower tray 20. This allows the cover 79 to pivot between a close position shown in FIG. 4 and an open position. The cover 79 when in the close position covers the front top of the lower tray 20, and when in the open position opens the front top of the lower tray 20. The front top of the lower tray 20 is closed or opened by operating the cover 79.

Figure 4:
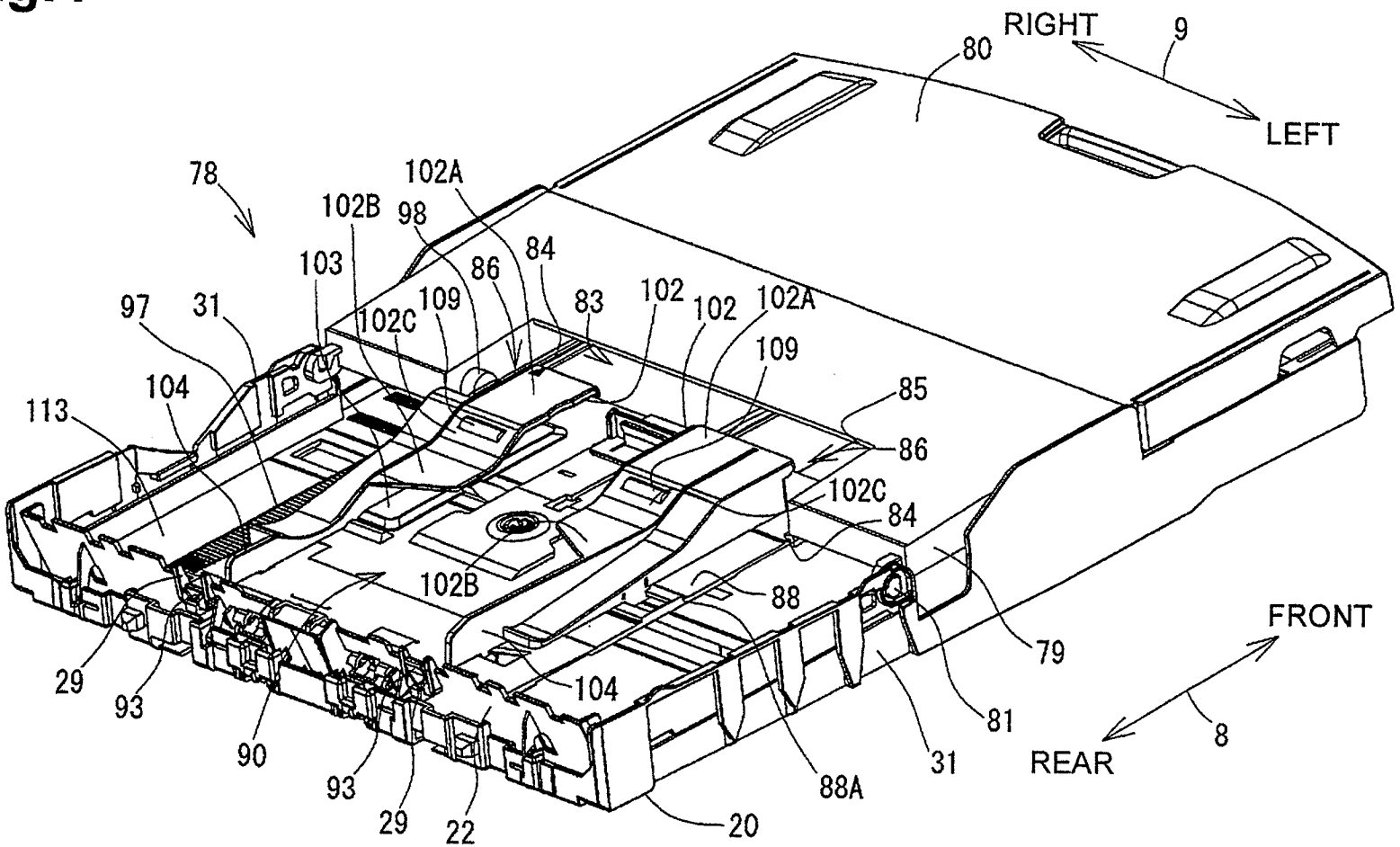
FIG. 4 is a rear perspective view of a sheet cassette of the printer in which an upper tray is in a feed position.

A space 83 for storing the upper tray 21 is defined inside the cover 79. The upper tray 21 is stored in the storing space 83 as needed. The cover 79 is configured to support the upper tray 21 slidably in the front-rear direction 8, parallel with the bottom surface 113 of the lower tray 20. As shown in FIG. 4, a rear wall of the cover 79 has an opening 85 through which the upper tray 21 moves into and out from the cover 79. Rails 84 may be formed on inner walls of the cover 79. Side edge portions 88A of a bottom plate 88 of the upper tray 21 may be inserted into the rails 84 such that the upper tray 21 slides with respect to the cover 79. Any structure other than the rails 84 and the side edge portions 88A may be employed as long as it allows the upper tray 21 to slide with respect to the cover 79.

The upper tray 21 comprises the bottom plate 88 and a pair of sides guides 86 disposed on the bottom plate 88. The pair of side guides 86 defines therebetween a storing portion 90 in which a stack of sheets are stored substantially horizontally. The upper tray 21 may be configured to store up to postcard size (100 mm×148 mm) sheets and to typically store postcard size, business card size, and photo L size sheets.

Figure 6A:
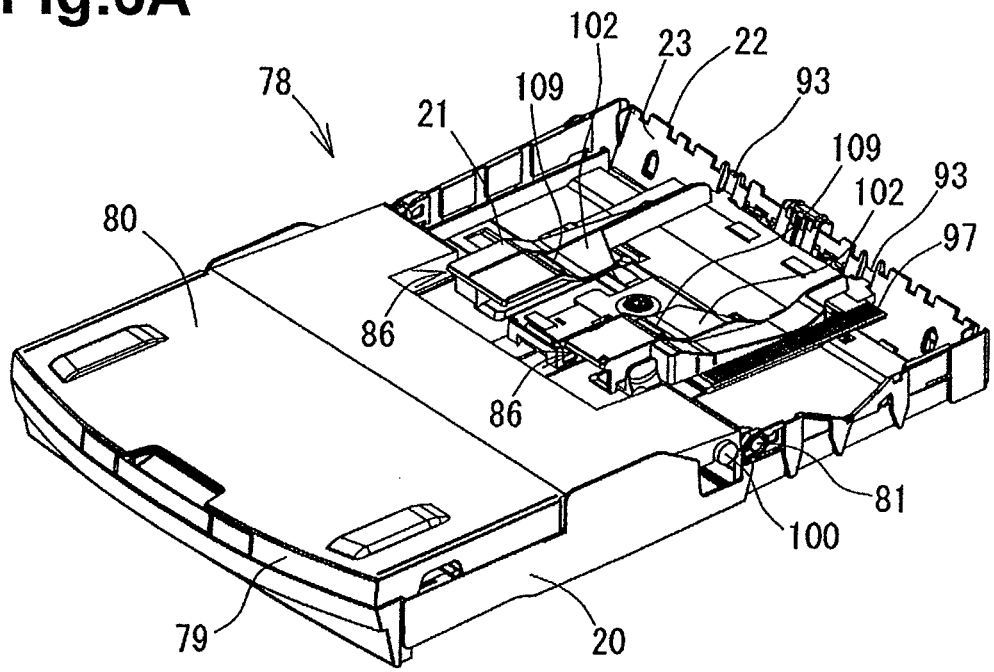
FIG. 6A is a front perspective view of the sheet cassette in which the upper tray is in the feed position.
Figure 6B:
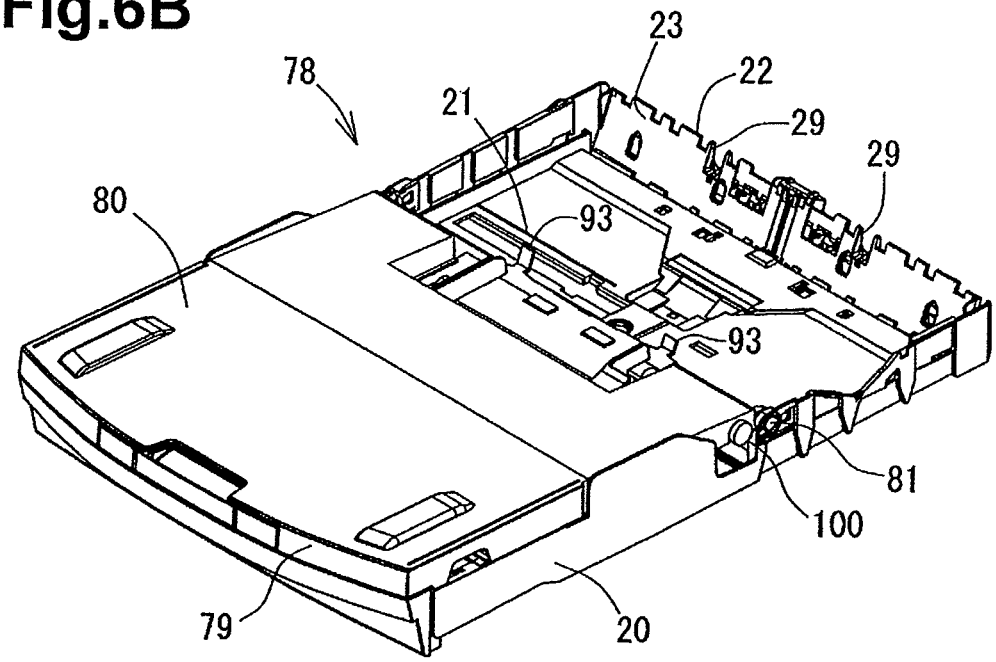
FIG. 6B is a front perspective view of the sheet cassette in which the upper tray is in a stored position.

The upper tray 21 is configured to slide, above the lower tray 20, between a feed position shown in FIG. 6A and a stored position shown in FIG. 6B. The upper tray 21 positioned in the feed position allows the sheet feeder 15 to feed sheets in the storing portion 9 of the upper tray 21. When the upper tray 21 is in the feed position, a rear end 92 (FIG. 5) of the upper tray 21 contacts the inner surface 23 of the separation plate 22, and the engaging portions 93 having an L shape are inserted into and received by the recesses 20 of the separation plate 22. When the upper tray 21 is in the stored position, the upper tray 21 is retracted frontward from the feed position and stored in the storing space 84 under the cover 79.

The upper tray 21 is driven to slide in the front-rear direction 8 by a motor or the like, via a transmission mechanism 96. As shown in FIG. 5, the transmission mechanism 96 comprises a rack gear 97 formed integrally with an upper surface of the bottom plate 88, a drive shaft 99 having a pinion gear 98 meshed with the rack gear 97, and an intermediate gear 100 mounted on the drive shaft 99. The rack gear 97 extends in the front-rear direction at a right end of the upper surface of the bottom plate 88. The drive shaft 99 extends to a side wall 31, and the intermediate gear 100 is mounted on the extending end of the drive shaft 99. When the sheet cassette 78 is inserted into the printer 11, a transmission gear (not shown) meshes with the intermediate gear 100. When a motor (not shown) connected to the transmission gear is driven, the upper tray 21 slides.

As shown in FIG. 4, the pair of side guides 86 restricts the position of sheets stored in the storing portion 90 in the right-left direction 9, i.e., in a widthwise direction of the upper tray 20. By sliding the side guides 86 and bringing the side guides 86 into contact with side edges of the sheets stored in the storing portion 90, the sheets are positioned on the bottom plate 88 with respect to a reference point such that a widthwise center of the sheets is aligned with the reference point.

Each of the side guides 86 comprises a sliding portion 103, vertical portion 104, and a upper plate 102. The sliding portion 103 is supported on the bottom plate 88 slidably along the upper surface of the bottom plate 88 in the right-left direction 9. As one of the sliding portions 103 is moved, the other of the sliding portions 103 moves symmetrically with respect to the reference point by use of a rack gear and a pinion gear.

The vertical portion 104 stands vertically from an outer edge of the sliding portion 104 in the right-left direction 9. An inner surface of the vertical portion 104 is perpendicular to the bottom plate 88 and is brought into contact with right or left side edges of the sheets in the storing portion 90.

The upper plate 102 projects from the upper edge of the vertical portion 104 parallel with the bottom plate 88 in the right-left direction 9, toward the storing portion 90. The upper plate 102 extends from a substantially middle portion of the bottom plate 88 to a substantially front end of the bottom plate 88 in the front-rear direction 8. An upper surface of the upper plate 102 partially defines a horizontal path 67B and serves as a guide member for guiding a sheet conveyed along the reverse path 67 when the sheet cassette 78 is inserted into the printer 11 and the upper tray 21 is positioned in the feed position.

The upper surface of the upper plate 102 comprises a flat guide 102A, a flat guide 102B lower than the flat guide 102A, and a inclined surface 102C between the flat guide 102A and the flat guides 102B. The flat guide 102B is positioned upstream of the flat guide 102B in the second direction. The flat guides 102A, 102B have an upper surface substantially parallel with the bottom plate 88, and the inclined surface 102C is inclined with respect to the bottom surface 88. When a sheet having an image recorded on the front side thereof is conveyed along the reverse path 67, the guide surface 102A is in such a position to receive the sheet conveyed along the inclined path 67A. The inclined surface 102C is positioned substantially below the third convey roller 64 and is not in contact with a roller surface of the third convey roller 64. The inclined surface 102C is inclined downward from the guide surface 102A so as not to contact the third convey roller 64.

The third pinch roller 109 is supported rotatably on the upper plate 102. A roller surface of the third pinch roller 109 is exposed upward from the inclined surface 102C. The third pinch roller 109 is urged toward the reverse path 67 by an elastic member 111, e.g., a coil spring, disposed at the back side of the inclined surface 102C. When the upper tray 21 is in the feed position, the third pinch roller 109 is pressed against the third convey roller 64.

Two side guides 86 are arranged spaced from each other in the right-left direction 9, i.e., a widthwise direction of the upper tray 21. Two third pinch rollers 109 are supported rotatably on respective two upper plates 102 such that rotation axes of the two third pinch rollers 109 extend parallel with the right-left direction 9 and are aligned with each other.

As described above, the side guides 86 are configured to slide in the right-left direction 9. Thus, as the side guides 86 slide, the third pinch rollers 109 move in the right-left direction 9. The positions and lengths in the right-left direction 9 of the third convey roller 64 and the third pinch rollers 109 are selected such that the third convey roller 64 contacts the third pinch rollers 109 regardless of the positions of the side guides 86 when the upper tray 21 is in the feed position.

When the upper tray 21 is in the feed position, the upper plates 102 are positioned upstream of the separation plate 22 in the second direction. Also, the upper plates 102 are positioned upstream of the inner guide 19 and the outer guide 18 by predetermined distances in the second direction and away from the inner and outer guides 19, 18. The predetermined distances are selected as appropriate based on the heights of vertical portions 104, the curvature of the curved path 65A, the inclination of the separation plate 22 and the like.

When the upper tray 21 slides from the stored position to the feed position, the rear end 92 pushes the arm 26 upward, and then the arm 26 pivots toward the bottom plate 88 of the upper tray 21, and the feed roller 25 contacts an upper surface of the sheets stored in the upper tray 21. When the feed roller 25 rotates in this state, an uppermost sheet is fed to the curved path 65A.

On the other hand, when the upper tray 21 slides from the feed position to the stored position, a top rear portion of the lower tray 20 is opened, and then the feed roller 25 moves down toward the bottom surface 113 of the lower tray 20 through the top rear opening of the lower tray 20, and contacts an upper surface of the sheets stored in the lower tray 20. When the feed roller 25 rotates in this state, an uppermost sheet is fed to the curved path 65A.

Figure 7A:
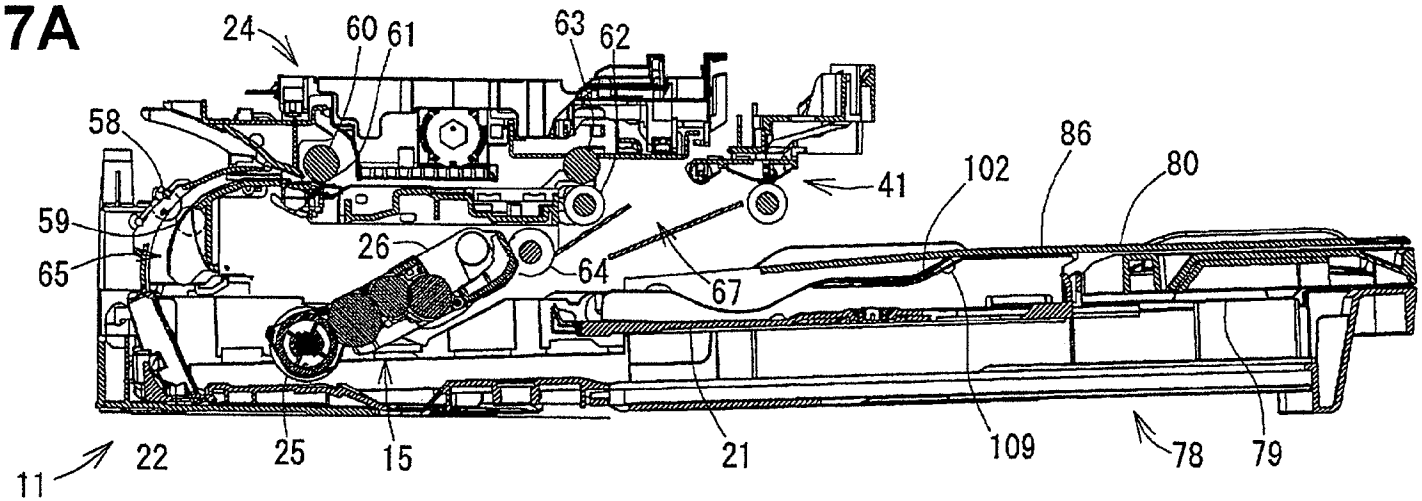
FIG. 7A is a vertical cross-sectional view of the printer in which the upper tray is in the stored position.
Figure 7B:
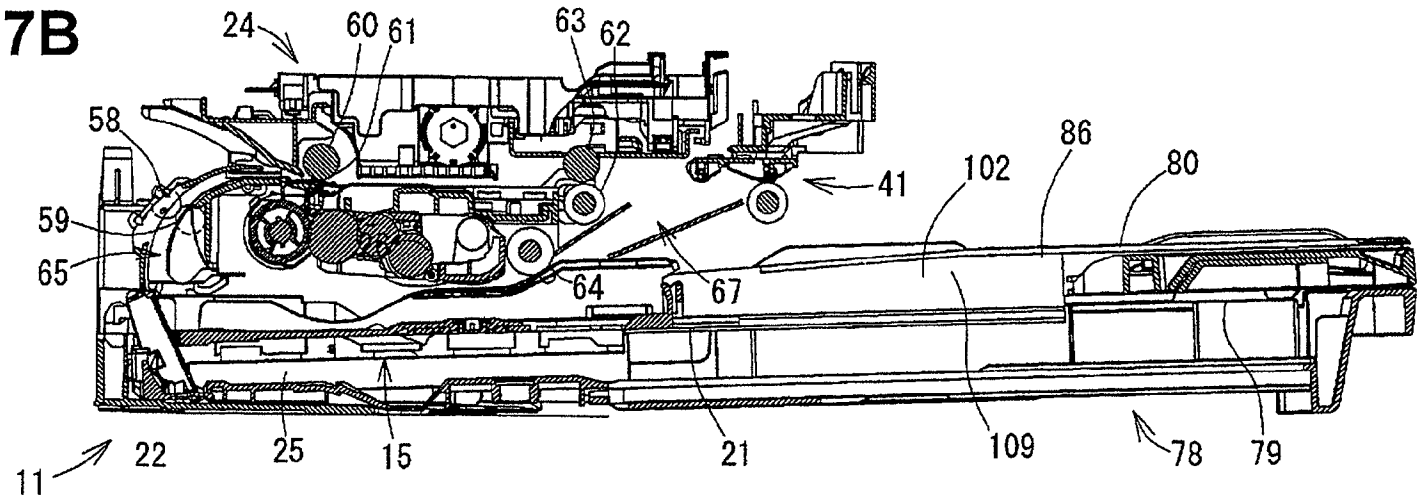
FIG. 7B is a vertical cross-sectional view of the printer in which the upper tray is in the feed position and a feed arm pivots upward.

When a sheet having passed the recording unit 24 is directed to the reverse path 67 by the path switching unit 41, the arm 26 is configured to move up such that the feed roller 25 retracts upward from the horizontal path 67B, as shown in FIG. 7B. The sheet is conveyed along the horizontal path 67B while the feed roller 25 is away from the sheet.

Referring to FIG. 3, the path switching unit 41 is described in detail. The path switching unit 41 is disposed along the discharging path 65B at the branch portion 36 where the reverse path 67 branches from the discharging path 65B. The path switching unit 41 comprises first roller 45 and second roller 46, and an auxiliary roller 47 disposed parallel with the second roller 46.

A pair of rollers 45, 46 pinches a sheet conveyed from the discharge roller 62 and the spur roller 63, and convey the sheet further downstream along the discharging path 65B toward the sheet receiving surface 80 or convey the sheet along the reverse path 16.

The second roller 46 and the auxiliary roller 47 are mounted to a frame 48. The frame 48 may extend in the right-left direction 9 of the multi-function device 10, i.e., a direction perpendicular to the sheet plane of FIG. 3. Second rollers 46 and auxiliary rollers 47 may be arranged at predetermined intervals in the right-left direction, i.e., a widthwise direction of the multi-function device 10, and may be supported on respective shafts extending in a direction perpendicular to the sheet plane of FIG. 3. The second roller 46 and the auxiliary roller 47 may have a spur shape, similar to the spur shape of the spur roller 63. The second roller 46 may be biased toward the first roller 45 by an elastic member.

The first roller 45 is driven by a motor (not shown) via a predetermined transmission mechanism. The first roller 45 has a center shaft 52 that is supported by a frame of the printer 11.

The second roller 46 is disposed on the first rollers 45. The first roller 45 is driven by the motor (not shown) to rotate forwardly or reversely. The sheet conveyed from the recording unit 24 along the discharging path 65B is pinched by the first roller 45 and the second roller 46.

The path switching unit 41 is configured such that the frame 48, the second roller 46, and the auxiliary roller 47 pivot, as a single body, about the center shaft 52. The path switching unit 41 changes its position depending on whether or not a driving force is transmitted thereto from the motor (not shown). More specifically, the path switching unit 41 changes between a discharging position and a reversing position. When in the discharging position shown in FIG. 8A, the path switching unit 41 discharges the sheet having passed the recording unit 24 toward the sheet receiving surface 80. When in the reversing position shown in FIG. 8B, the path switching unit 41 directs the sheet having passed the recording unit 24 in the second direction along the reverse path 67.

When the first roller 45 is driven by the motor to rotate forwardly, e.g., clockwise in FIG. 3, the path switching unit 41 remains in the discharging position. In the single-sided recording mode, the first roller 45 rotates forwardly continuously while the first roller 45 and the second roller 46 pinch the sheet having an image recorded on the front side thereof, and the sheet is conveyed downstream and discharged onto the sheet receiving surface 80.

In the double-sided recording mode, the path switching unit 41 changes its position from the discharging position to the reversing position while the first roller 45 and the second roller 46 pinch a trailing edge of the sheet having an image recorded on the front side thereof. This positional change is caused when the rotation direction of the motor is changed and the first roller rotates reversely, e.g., counterclockwise in FIG. 3. The sheet is pressed downward by the auxiliary roller 47 and is conveyed in the second direction along the inclined path 67A with the trailing edge as a leading edge.

In this embodiment, the driving force of the motor is transmitted to the feed roller 25 via the shaft 28 when the first roller 45 rotates forwardly, and the driving force is not transmitted to the feed roller 25 and the arm 26 pivots more upward than the horizontal path 67B of the reverse path 67 when the first roller 45 rotates reversely. In other words, the sheet feeder 15 is inactive when the first roller 45 and the third convey roller 64 are conveying the sheet along the reverse path 67. This is achieved by controlling the motor for driving the feed roller 25 independently of the motor for driving the first roller 45 and the third convey roller 64 and by moving up and down the arm 26 using a link mechanism or a motor. In another embodiment of the invention, this may be achieved by using a transmission switching member, e.g., a clutch or a planet gear, for a transmission system where the feed roller 25, the first roller 45, and the third convey roller 64 are driven by a single common motor.

Referring to FIGS. 8 and 9, an image recording operation by the printer 11 onto a sheet from the upper tray 21 is described in detail.

When the printer 11 operates in the single-sided recording mode to record an image on one side of a sheet from the upper tray 21, a sheet S is fed from the upper tray 21 by the feed roller 25 and conveyed along the curved path 65A to the recording unit 24. At this time, the sheet S is conveyed upward along the curved path 65A such that the sheet S makes a U-turn. The sheet is flipped over such that a front side thereof opposite to a side the feed roller 25 has contacted faces the recording unit 24.

When a leading edge of the sheet S enters the curved path 65A, the leading edge contacts the guide surface 18A of the outer guide 18 and is directed upward. As the sheet S passes upward along the curved path 65A, the inclination of the sheet S with respect to the upper tray 21 increases. When the sheet S is inclined at a certain angle, the sheet S contacts a lower surface of the upper plate 102 and then the sheet S starts being bent. Thus, the sheet S is fed from the upper tray 21 to the curved path 65A smoothly without being bent excessively.

Figure 8A:
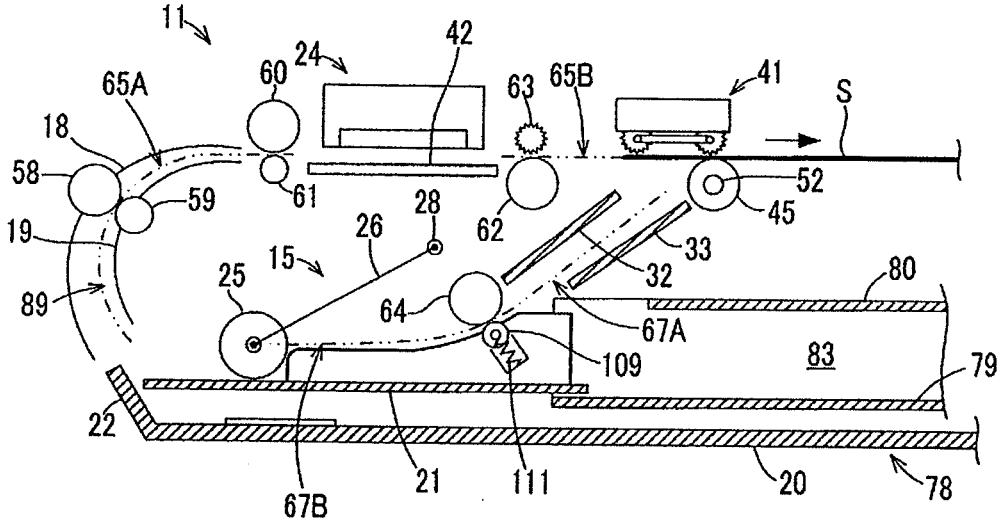
FIGS. 8A and 8B are schematic views illustrating a sheet feeding operation in time sequence.

Then, the sheet S is conveyed by the feed roller 25 and the first convey roller 58 while being bent along the curved path 65A. When the sheet S reaches the second convey roller 60 and the second pinch roller 61, the sheet S is conveyed by the rollers 60, 61 into between the recording unit 24 and the platen 42. The recording unit 24 records an image on the front side of the sheet S. Then, as shown in FIG. 8A, the sheet S is conveyed along the discharging path 65B and discharged by the discharge roller 62 and the spur roller 63 onto the sheet receiving surface 80.

Figure 8B:
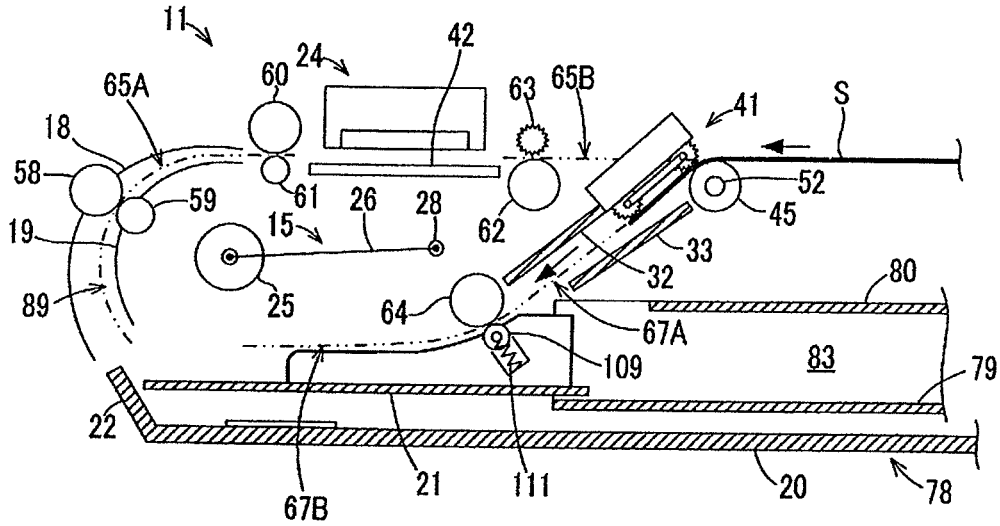

When the printer 11 operates in the double-sided recording mode to record an image on both sides of a sheet from the upper tray 21, a sheet having an image recorded on the front side thereof and reaching the first roller 45 and the second roller 46 is conveyed downward further by the rollers 45, 46. Then, as shown in FIG. 8B, in a state where a trailing edge of the sheet S is pinched between the first roller 45 and the second roller 46, the rotation direction of the first roller 45 is changed to reverse. When a driving force of the first roller 45 rotating reversely is transmitted to the path switching unit 41, the path switching unit 45 pivots counterclockwise about the center shaft 52 and changes its position from the discharging position shown in FIG. 8A to the reversing position shown in FIG. 8B. The trailing edge of the sheet S, now as a leading edge, enters the reverse path 67. At this time, the arm 26 is raised upward by a driving force transmitting mechanism (not shown) or a link mechanism (not shown) such that the feed roller 25 is retracted upward from the horizontal path 67B.

Figure 9A:
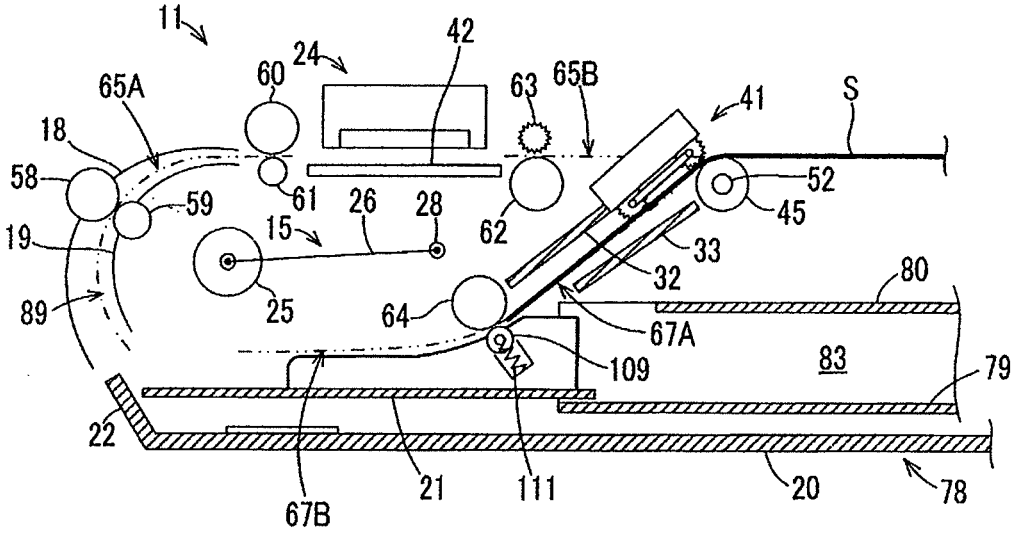
FIGS. 9A and 9B are schematic views illustrating a sheet feeding operation in time sequence.

Then, the sheet S is conveyed along the inclined path 67A by the first roller 45 and the second roller 46 that rotate reversely. As shown in FIG. 9A, when the sheet S reaches the third convey roller 64 and the third pinch roller 109, the sheet S is pinched by the rollers 64, 109 and conveyed along the horizontal path 67B to the curved path 67A while being supported on upper surfaces of the upper plates 102 of the side guides 86.

Figure 9B:
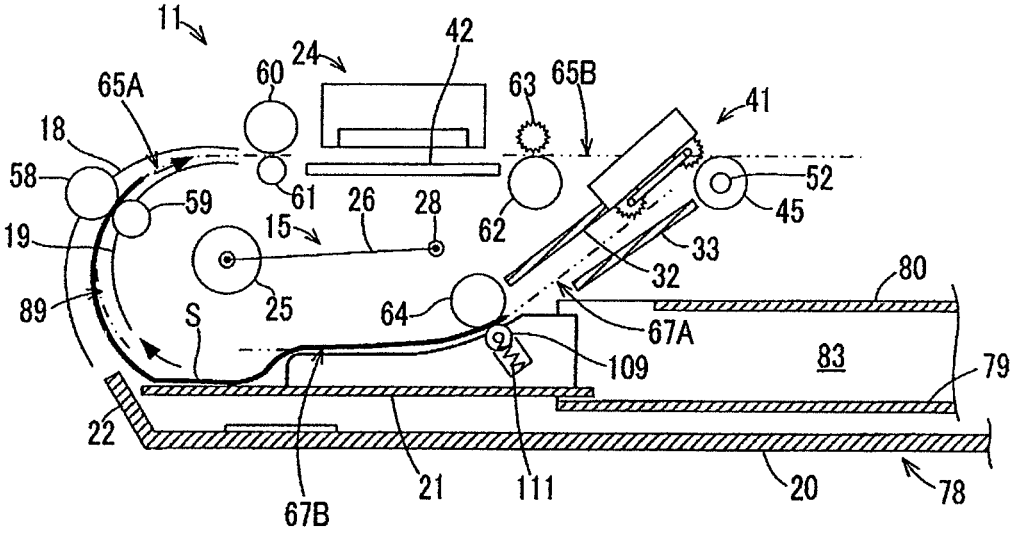

Because the upper plates 102 are positioned away from the separation plate 22 by the predetermined distance, the leading edge of the sheet S falls downward from the upper plates 102 when the sheet S approaches the separation plate 22, and the sheet S enters the curved path 65A while being supported on an upper surface of the sheets stored in the upper tray 21, as shown in FIG. 9B. The sheet S is bent along the curved path 65A as the sheet passes along the curved path 65A. By the falling of the sheet S downward from the upper plates 102, the curvature of the sheet S being bent along the curved path 65A becomes small. Thus, the sheet S is fed from the reverse path 67 to the curved path 65A smoothly without being bent excessively. The sheet S is bent relatively gently along the curved path 65A. This may reduce friction between the sheet S and the guide surface 18A and friction between the sheet S and the upper plates 102 and enable smooth conveyance of the sheet S from the horizontal path 67B to the curved path 65A.

The sheet S fed back to the curved path 65A is conveyed by the third convey roller 64 and the first convey roller 58. When the sheet S reaches the second convey roller 60 and the second pinch roller 61, the sheet S is conveyed by the rollers 60, 61 into between the recording unit 24 and the platen 42. The recording unit 24 records an image on the back side of the sheet S. Then, the sheet S is conveyed along the discharging path 65B and discharged by the discharge roller 62 and the spur roller 63 onto the sheet receiving surface 80. The path switching unit 41 is driven to change its position from the reversing position to the discharging position before the leading edge of the sheet S enters the path switching unit 41.

When the printer 11 operates in the single-sided recording mode to record an image on one side of a sheet from the lower tray 20, the upper tray 21 is kept in the stored position. The printer 11 operates similarly to when the printer 11 operates, as described above, in the single-sided recording mode for a sheet fed from the upper tray 21.

When the printer 11 operates in the double-sided recording mode to record an image on both sides of a sheet from the lower tray 20, the upper tray 21 is positioned in the stored position shown in FIG. 6B before a sheet is fed from the lower tray 20. After the sheet is fed from the lower tray 20, the upper tray 21 is driven to slide from the stored position to the feed position shown in FIG. 6A. The sheet having an image on the front side thereof is conveyed along the reverse path 67 and fed back to the curved path 65A similarly to when the printer 11 records, as described above, an image on the back side of a sheet fed from the upper tray 21.

Figure 10A:
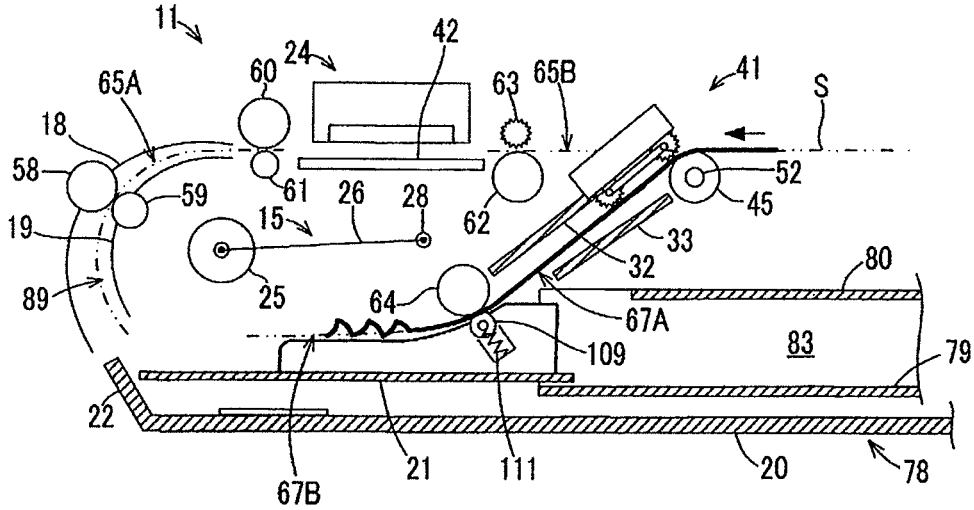
FIGS. 10A and 10B are schematic views illustrating how to remove a jammed sheet.
Figure 10B:
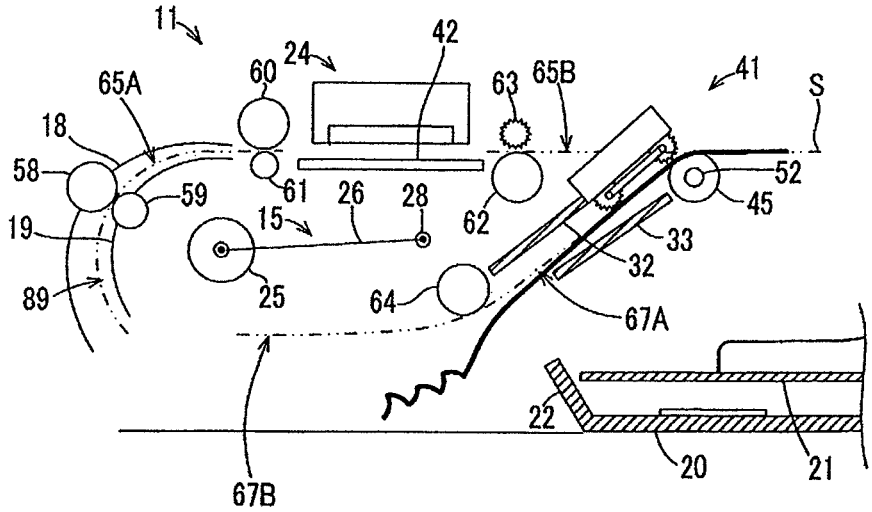

In the above-described embodiment, the third pinch rollers 109 are disposed at the upper surfaces of the upper plates 102 of the side guides 86 of the upper tray 21. The third pinch rollers 109 contact the third convey roller 64 when the sheet cassette 78 is inserted into the printer 11 and the upper tray 21 is in the feed position, as shown in FIG. 10A. The third pinch rollers 109 leave the third convey roller 64 when the sheet cassette 78 is removed from the printer 11, as shown in FIG. 10B. Thus, as shown in FIG. 10B, if a sheet is jammed at the reverse path 67 while being pinched by the third convey roller 64 and the third pinch roller 109, the jammed sheet S may be eliminated readily by removing the sheet cassette 78 from the printer 11. When the jammed sheet S is eliminated, the third convey roller 64 is unlikely to be stained with the ink on the sheet S because the third convey roller 64 and the recording surface are away from each other.

The upper surfaces of the upper plates 102 of the side guides 86 define a part of the reverse path 67, i.e., the horizontal path 67B. Thus, there is no need to implement a separate guide member, other than the side guides 86, to define the horizontal path 67B. This may simplify the structure of the reverse path 67 and lower the height of the printer 11 by the height of the separate guide member.

In the above-described embodiment, the sheet cassette 78 comprises the lower tray 20 and the upper tray 21 arranged in two layer. Nevertheless, the sheet cassette 78 may only have the upper tray 21.

In the above-described embodiment, each of the pair of side guides 86 comprises the upper plate 102 and the third pinch roller 109, and two upper plates 102 and two third pinch rollers 109 are arranged at both widthwise sides of the upper tray 21. Nevertheless, only one of the side guides 86 may comprise an upper plate 102 and a third pinch roller 109 that are positioned at the widthwise center of the upper tray 102.

Although, in the above-described embodiment, the upper tray 21 is configured to slide by the motor, via the transmission mechanism 96, a link mechanism may be used such that the upper tray 21 slides from the stored position to the feed position as the path switching unit 41 moves from discharging position to the reversing position.

In the above-described embodiment, the upper plate 102 having the third pinch roller 109 is used as a guide member that partially defines the reverse path 67 for conveying a sheet when the printer 11 operates in the double-sided recording mode. Nevertheless, the upper plate 102 having the third pinch roller 109 may be used when the printer 11 records an image on the front side of a sheet twice and conveys the sheet having an image on the front side thereof back to the recording unit such that the front side thereof faces the recording unit.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording apparatus comprising:

a particular tray configured to hold a plurality of sheets on a sheet holding surface, the particular tray comprising at least one side guide configured to move in a widthwise direction and to contact side edges of the plurality of sheets held on the sheet holding surface;

a sheet feeder configured to feed a sheet of the plurality of sheets to a first conveying path, in a feed direction perpendicular to the widthwise direction;

a recording unit positioned along the first conveying path and configured to record an image on the fed sheet; and a driving roller positioned along a second conveying path and configured to convey the sheet, after the sheet passes the recording unit, along the second conveying path and back to the first conveying path, wherein the first conveying path and the second conveying path overlap at positions upstream and downstream of the recording unit in the feed direction, and wherein the at least one side guide of the particular tray each comprises:

a guide portion that defines at least a portion of the second conveying path and is configured to guide the sheet along the second conveying path and to move together with the at least one side guide; and a driven roller rotatably supported on the guide portion and configured to contact the driving roller, and to pinch the sheet against the driving roller as the sheet is conveyed along the second conveying path.

2. The image recording apparatus according to claim 1, further comprising a further tray configured to store a plurality of sheets, wherein the particular tray is configured to selectively slide above the further tray, into and away from a feed position, the driven roller is configured to contact the driving roller when the particular tray is in the feed position, and the sheet feeder is configured to selectively feed the sheet from one of the particular tray positioned in the feed position and the further tray.

3. The image recording apparatus according to claim 1, wherein the at least one side guide comprises a vertical portion having a surface extending perpendicular to the sheet holding surface of the particular tray and configured to contact the side edges of the plurality of sheets, and wherein the guide portion of the at least one side guide extends along the sheet holding surface of the particular tray from the vertical portion, in the widthwise direction.

4. The image recording apparatus according to claim 1, wherein the guide portion has an inclined surface that is inclined with respect to the sheet holding surface of the particular tray, and wherein a rotation axis of the driven roller extends along the widthwise direction, such that a roller surface of the driven roller projects upward from the inclined surface.

5. The image recording apparatus according to claim 1, wherein the at least one side guide further comprises an urging member positioned adjacent to the guide portion and configured to urge the driven roller in an upward direction.

6. The image recording apparatus according to claim 1, wherein the at least one side guide is positioned on the sheet holding surface of the particular tray and configured to be slidable in the widthwise direction.

7. The image recording apparatus according to claim 1, wherein the at least one side guide comprises two side guides separated from each other in the widthwise direction, and a driven roller of each of the two side guides is rotatably supported on a corresponding one of two guide portions, such that rotation axes of the two driven rollers are aligned with each other and extend parallel with the widthwise direction.

8. The image recording apparatus according to claim 2, further comprising an outer guide and an inner guide configured to define a curved portion of the first conveying path, wherein when the particular tray is in the feed position, the guide portion of the at least one side guide is separated from the outer guide and the inner guide by predetermined distances, respectively.

9. The image recording apparatus according to claim 2, wherein the sheet feeder comprises:

an arm comprising a first end and a second end opposite to the first end, wherein the arm is configured to pivot about the first end; and a feed roller rotatably attached to the second end of the arm, wherein the arm is configured to selectively pivot between a first arm position where the feed roller contacts the sheets in the particular tray, a second arm position where the feed roller contacts the sheets in the further tray, and a third arm position where the feed roller is positioned above the guide portion of the at least one side guide.

10. The image recording apparatus according to claim 9, wherein when the particular tray slides to the feed position, the particular tray is configured to contact the arm and to pivot the arm from the second arm position to the first arm position.

11. The image recording apparatus according to claim 1, further comprising a path switching unit positioned along the first conveying path, downstream of the recording unit in the feed direction, wherein the path switching unit is configured to selectively move between a discharging position where the path switching unit discharges the sheet along the first conveying path, and a reversing position where the path switching unit conveys the sheet along the second conveying path.

12. The image recording apparatus according to claim 2, further comprising a cover positioned on the further tray at a position that covers at least a portion of the further tray, wherein the particular tray is configured to slide above the further tray between the feed position and a position under the cover, and wherein the cover has an upper surface configured to receive the sheet discharged from the recording unit.

13. The image recording apparatus according to claim 1, further comprising a housing configured to house the sheet feeder, the recording unit, and the driving roller, wherein the particular tray is configured to be inserted into the housing, and wherein the driven roller of the at least one side guide of the particular tray is configured to contact the driving roller when the particular tray is inserted into the housing.

* * * * *